United States Patent [19]

Rahfield et al.

[11] Patent Number: 4,828,743

[45] Date of Patent: May 9, 1989

[54] COMPOSITION FOR RUST REMOVAL AND METHOD OF USE THEREOF

[75] Inventors: Susan Rahfield, Pine Brook; Benjamin Newman, Elizabeth, both of N.J.

[73] Assignee: Boyle-Midway Household Products, Inc., New York, N.Y.

[21] Appl. No.: 123,087

[22] Filed: Nov. 20, 1987

[51] Int. Cl.[4] ..... C23F 4/00; C23F 3/00

[52] U.S. Cl. ..... 252/87; 134/3; 134/41; 252/80; 252/81; 252/142

[58] Field of Search ..... 252/80, 81, 87, 142; 134/3, 41

[56] References Cited

U.S. PATENT DOCUMENTS

| | | | |
|---|---|---|---|
| 2,176,389 | 10/1939 | Brandt | 252/151 |
| 2,973,191 | 5/1971 | Streicher | 252/142 |
| 3,072,502 | 1/1963 | Alfano | 134/3 |
| 3,173,875 | 3/1965 | Wegst et al. | 252/105 |
| 3,248,269 | 1/1966 | Bell | 148/6.14 |
| 3,794,523 | 2/1974 | Thompson | 134/3 |
| 4,032,466 | 6/1977 | Otrhalek et al. | 252/136 |
| 4,276,185 | 6/1981 | Martin | 134/3 |
| 4,541,945 | 9/1985 | Anderson et al. | 252/86 |
| 4,623,399 | 11/1986 | Frenier | 252/82 |

OTHER PUBLICATIONS

Data Sheet 672, "Chemical Cleaning with Citric Acid Solutions", Pfizer Chemicals Division (1981).

*Primary Examiner*—Robert A. Wax

*Attorney, Agent, or Firm*—Arthur E. Wilfond; Richard A. Elder; Ronald W. Alice

[57] ABSTRACT

A non-phosphate cleaning composition, having enhanced rust removal properties at ambient temperatures, comprising oxalic acid and an activating amount of ferrous ion. This formulation removes rust better than formulations not containing the activating amount of ferrous ion.

8 Claims, No Drawings

COMPOSITION FOR RUST REMOVAL AND METHOD OF USE THEREOF

FIELD OF THE INVENTION

The present invention relates to a non-phosphate cleaning composition having enhanced rust removing properties at ambient temperatures and a method of use thereof.

BACKGROUND OF THE INVENTION

Removal of iron scale is a problem in many operations within the household. Such operations includes cleaning toilet bowls, sinks, tubs, tiles, etc. Preparations such as sold under the trademark Lime-A-Way of Economics Laboratory, Inc., St. Louis, have been used for removing lime rust and scale. Formulations listed on the Lime-A-Way packages may be sulfamic acid; a combination of sulfamic and hydroxyacetic acids; phosphoric and citric acids; phosphoric and hydroxyacetic acids; and citric acid. There are also patents to acidid cleaning preparations. One such cleaning preparation is disclosed by Otrahalek in U.S. Pat. No. 4,032,466 which teaches a thickened acid cleaner concentrate composition consisting essentially of: a strong aqueous inorganic acid in an amount from about 5 to about 78 weight percent; an organic acid selected from the group consisting of oxalic, tartaric, citric acid and mixtures thereof in an amount from about 1 to about 6 weight percent; a onionic surfactant in an amount from about 7 to about 23 weight percent; an anionic surfactant in an amount from about 1 to about 7 weight percent; a flocculating agent containing bivalent iron, trivalent iron or trivalent aluminum in soluble form in acid solution and in an amount of from about 1 to about 12 weight percent; and water in an amount from about 75 to about 12 weight percent; all weight percents being based on the total composition. The nonionic surfactant and the anionic surfactant when taken together constitute from about 10 to about 30 weight percent of the composition and the nonionic surfactant constitutes from about 75 to about 90 weight percent of the combined weight percent of nonionic and anionic surfactants. This composition forms ferrous hydroxide flocks when the acidic cleaning solution is made basic by the addition of an alkaline agent. Wegst et al. in U.S. Pat. No. 3,173,875 describe acid detergent compositions for removing stains from porcelain-type fixtures. These compositions comprise an aqueous acid detergent solution of at least about 0.2 weight percent of an acid selected from the group consisting of phosphoric acid, hydrochloric acid and mixtures thereof and at least about 0.5 weight percentof a water-soluble ferrous salt selected from the group consisting of ferrous chloride, ferrous sulfate, ferrous nitrate and mixtures thereof. While such formulations are suitable, phosphates are ecologically unsound. Thus, there is a desire to avoid both phosphates and phosphoric acid to reduce the load on disposal and waste systems. Thompson, in U.S. Pat. No. 3,794,523, discloses scale removal by an emulsion having an acidic outer phase of an acid selected from hydrochloric, hydrofluoric, acetic, sulfamic and formic acids and mixtures thereof. Streicher in U.S. Pat. No. 2,973,191 discloses a method of substantially inhibiting the corrosiveness, in aqueous solution of a cleaning solution of at least one acid from the group consisting of formic, acetic, sulfamic and glycolic acids, towards stainless steels, which comprises incorporating into the solution a minor amount of a ferric ion-contributing salt, other than an iron halide.

Pfizer's Citrosolv process was developed to remove boiler deposits at elevated temperatures containing iron oxides, copper oxides and copper metal in a single solution. It ostensibly eliminates time-consuming intermediate draining and rinsing steps common to mineral-acid cleaning practices. Pfizer in data sheet 672 copyrighted 1981 describing the Citrosolv process states on page 5:

"In many cases of chemical cleaning of iron oxides it is desirable to add a chemical reducing agent to the citric formula, which donates electrons of its own, and therefore speeds up the process of converting ferric iron to the more readily soluble ferrous iron. The addition of a reducing agent to the citrate formula is recommended in cases where the impervious nature of the oxide scale acts as a barrier to penetration by the solvent to the substrate, or where the substrate is a lesser source of electrons than ordinary carbon steels (eg, passive stainless steels). Traditionally, bisulfite and thiourea have been used for this purpose. More recently, ascorbic and erythorbic acids[2] have been used because of their nontoxic properties.

"Users of the Citrosolv Process [1] noted that levels of dissolved iron increased slowly at the start of a typical boiler cleaning. The rate accelerated once a small critical level of ferrous ion had been dissolved into solution. Working from this observation, it was found that the addition of small amounts of ferrous salts (0.05%) to the fresh Citrosolv solution shortens the total time to perform the boiler cleaning."

The references referred to in the super-scripts are U.S. Pat. Nos. 3,072,502 (Alfano) and 3,248,269 (Bell), as specified on page 20 of the Pfizer data sheet. The first of these patents (Alfano) describes a process for removing copper-containing iron oxide scale from metal surfaces, which comprises contacting the surfaces with an aqueous solution containing at least about 1% w/v citric acid together with sufficient base to provide a pH between about 2.5 and about 5; the base being selected from the group consisting of ammonia, an unsubstituted ethanolamine and a water-soluble aliphatic hydrocarbon amine, continuing the contact with the iron content of the solution becomes substantially constant, subsequently adjusting the pH of the solution with one of the bases to a value between about 8 and about 10, and maintaining the pH within the alkaline range while continuing said contact until the copper content of said solution becomes substantially constant. The second of these patents (Bell) describes a method of removing copper-containing iron oxide scale from metal surfaces, consisting essentially of contacting the surfaces with a composition comprising a substantially neutral aqueous solution of ammonium citrate, continuing the contact until the iron content of the solution becomes substantially constant as the pH rises, then continuing the contact at a pH of at least 9 and maintaining the pH with ammonia until the copper content of the solution becomes substantially constant. The contacting method is carried out at elevated temperatures and pressures.

Notwithstanding the above quotation, neither Alfano nor Bell discloses the use of ferrous ion to remove rust. When Pfizer Chemical Division Technical Service Center was questioned on this issue, applicants were advised that Pfizer had not been able to show in the lab that addition of an iron reducing agent to citric acid speeds magnetite dissolution and that they are a bit puzzled by the statement in their literature. Although the Pfizer publication makes allusion that addition of ferrous ion to the citrate formulation speeds magnetite dissolution, the facts do not bear out the same.

SUMMARY OF THE INVENTION

A non-phosphate cleaning composition, having enhanced rust removal properties at ambient temperatures, comprising oxalic acid and an activating amount of ferrous ion. We have also found that the use of this formulation removes rust better than formulations not containing the activating amount of ferrous ion.

DETAILED DESCRIPTION OF THE INVENTION

Our non-phosphate cleaning composition has enhanced rust removal properties at ambient temperatures. It comprises oxalic acid and an activating amount of ferrous ion. The use of this formulation removes rust better than formulations not containing the activating amount of ferrous ion.

The preferred activating amount of ferrous ion ranges from 0.01% to 0.6%. All percentages are by weight. While higher amounts such as 1%, of ferrous ion will also work, they tend to precipitate out. For aesthetic reasons, this is not desirable in a liquid formulation to have solid particles floating in the liquid, unless the formulation is in an opaque container. The source of the ferrous ion is not critical, provided however, the ferrous containing compound is water soluble. Thus, for example, compounds such as (ferrous) iron naphthenate, which are commercially available, are not satisfactory, because these compounds are not soluble in aqueous media. It is not critical, whether the ferrous ion containing substance is organic or inorganic. Both classes of compounds are satisfactory, provided, however, they yield the ferrous ion. Illustratory inorganic compounds are ferrous acetate, ferrous gluconate, ferrous methoxide and ferrous oxalate. Ferrous gluconate is preferred. Illustratory inorganic compounds are ferrous chloride, ferrous fluoride, ferrous tetrafluoroborate, ferrous ammonium sulfate and ferrous sulfate. Ferrous sulfate is preferred.

A series of tests were carried out showing variations in the parameters of our method. The ingredients were tested separately, in combination, and in comparison to competitive products with other rust dissolving ingredients. The liquid formulations were prepared by weighing out appropriate amounts of ingredients, and adding them sequentially to water, prefereably but not necessarily, at elevated temperature. Although the order of ingredients is not overly critical, when sulfamic acid is present, it should be added prior to the ferrous ion source.

An illustratory preparation of a specific formulation is that of Example 12 wherein 2.0 grams of oxalic acid dihydrate was added to 54.7 grams of water and mixed until dissolved. Thereafter 30.0 grams hydroxyacetic acid was added and mixed until uniformly dispersed. This was followed by 13.0 grams of sulfamic acid, which was mixed until dissolved. Lastly 0.3 grams of ferrous sulfate was added to the solution and mixed until dissolved.

The formulations of Examples 1–17 below were prepared in an analagous manner to that of Example 12 above.

The test method involved determination of stain removal from a rust-stain tile and is as follows:

1. Etch with HF, $4\frac{1}{2}'' \times 8\frac{1}{2}''$ white tiles.
2. Draw eight two-inch squares on the tiles with a pencil.
3. Make an initial "original" reading in the center of each square using a photovolt reflectometer.
4. Stain the tiles with rust.
5. Measure the reflectance again in the center and record as "stained" reading.
6. Apply 0.8 g of each sample and spread on the top surface of the tile within one of the two inch squares. To minimize the application-time variation between samples, utilize only four squares on each tile.
7. Allow the treated tiles to stand 5 minutes.
8. Rinse the tile in tap water.
9. Dry the tile by patting very gently with a paper towel.
10. Determine the reflectance in the center of the squares, and record as "cleaned" readings.
11. Calculate % stain removal using the formula:

$$\% \text{ Stain Removal} = \frac{\text{Cleaned Reading} - \text{Stained Reading}}{\text{Original Reading} - \text{Stained Reading}} \times 100$$

The results of these tests are shown on the table of examples hereinbelow:

Examples 1–17

| | Example | | | | | | | | |
|---|---|---|---|---|---|---|---|---|---|
| | 1 | 2 | 3 | 4 | 5 | 6 | 7 | 8 | 9 |
| Oxalic Acid* | 2.0% | 2.0% | — | — | — | — | 2.0% | 2.0% | 2.0% |
| Sulfamic Acid | — | — | 13.0% | 13.0% | — | — | 13.0% | 13.0% | — |
| Hydroxyacetic Acid* | — | — | — | — | 30.0% | 30.0% | — | — | 30.0% |
| Ferrous Sulfate** | — | 0.3% | — | 0.3% | — | 0.3% | — | 0.3% | — |
| Citric Acid | — | — | — | — | — | — | — | — | — |
| Phosphoric Acid | — | — | — | — | — | — | — | — | — |
| Stain Removal % | 26 | 83 | 12 | 9 | 4 | 6 | 43 | 87 | 13 |

| | Example | | | | | | | |
|---|---|---|---|---|---|---|---|---|
| | 10 | 11 | 12 | 13 | 14 | 15 | 16 | 17 |
| Oxalic Acid* | 2.0% | 2.0% | 2.0% | — | — | — | — | 2.0 |
| Sulfamic Acid | — | 13.0% | 13.0% | — | — | — | — | 13.0% |
| Hydroxyacetic Acid** | 30.0% | 30.0% | 30.0% | — | — | — | — | — |
| Ferrous Sulfate*** | 0.3% | — | 0.3% | — | 0.3% | — | 0.3% | 1.0% |
| Citric Acid | — | — | — | 30.0% | 30.0% | — | — | — |
| Phosphoric Acid | — | — | — | — | — | 21.5% | 21.5% | — |

-continued

| Examples 1–17 | | | | | | | | |
|---|---|---|---|---|---|---|---|---|
| Stain Removal % | 72 | 14 | 75 | 3 | 1 | 56 | 81 | 93 |

*Dihydrate
** 70%
***Heptahydrate

Comparing the above tabulated test results shows the efficatiousness of our formulation. The addition of ferrous sulfate in Example 2 to the oxalic acid of Example 1 shows an increase of stain removal from 26% to 83%. There is a slight decrease when ferrous sulfate is added (Example 4) to the sulfamic acid of Example 3. There is no significant difference between hydroxyacetic acid alone (Example 5) or with ferrous sulfate (Example 6).

Examples 7–10 show combinations of two actives with and without ferrous sulfate. Example 7 shows the combination of oxalic acid and sulfamic acid, while example 9 shows the combination of oxalic acid and hydroxyacetic acid. A significant improvement is seen in the rust removal properties when 0.3% ferrous sulfate is added in Examples 8 and 10 respectively. Example 11 shows the combination of oxalic acid, sulfamic acid and hydroxyactic acid, while Example 12 adds thereto ferrous sulfate. The stain removal jumps from 14% in Example 11 to 75% in Example 12. It is thus seen that when ferrous sulfate is added to the various ingredients, with the exception of sulfamic acid, an improvement of stain removal properties occurs.

Example 13 shows 30% citric acid, at ambient temperatures, has poor rust stain removing properties. The addition of ferrous ion, in the form of 0.3% does not improve the rust removal properties. Example 15 shows that 21.5% phosphoric acid has significant rust removal properties (56%) and Example 16 shows that property is enhanced (81%) when 0.3% ferrous sulfate is added.

Example 17 shows the effect of increased levels of ferrous ion as the sulfate. In this example, 1% ferrous sulfate is added to 2.0% oxalic acid and 13% sulfamic acid and provides 93% stain removal. Compare this to Examples 7 and 8 respectively without and with 0.3% ferrous sulfate.

Preparation of Example 18

Example 18 below, goes from a limited ingredient formulation to a potentially commercial formulation. This formulation batch was prepared a follows and had the indicated physical characteristics:

| Ingredients | % by weight | Grams |
|---|---|---|
| Water, deionized | 25.39 | 1015.6 |
| Veegum T (3% solution) | 22.33 | 893.2 |
| Oxalic Acid, dihydrate | 2.00 | 80.0 |
| Hydroxyacetic Acid 70% | 28.60 | 1144.0 |
| Sulfamic Acid | 7.00 | 280.0 |
| Ferrous Sulfate, heptahydrate | 0.3 | 12.0 |
| Rhodopol 23 | 0.34 | 13.6 |
| Surfonic N-95 | 1.00 | 40.0 |
| Acid Foamer | 3.00 | 120.0 |
| Kaopolite 1168 | 10.00 | 400.0 |
| Graphtol Green 5869-2 | 0.04 | 1.6 |
| | 100.00 | 4000.0 |

The water was added to a stainless steel beaker. The Veegum solution was added to the water and mixed with a propeller type mixer and heated to 160° F. The oxalic acid was added to the mixture and mixed until dissolved. The hydroxyacetc acid was then added and mixed in. The sulfamic acid was then added and mixed until dissolved. The solution was cooled to 80° F. The ferrous sulfate was added to the solution and mixed until dissolved. Rhodopol was then added while being homogenized for about 45 minutes. Using a lightning type mixer with a propeller blade, the 158g water, lost through evaporation, was added to the solution and mixed in. The Surfonic was added and mixed until dissolved. The kaopolite was then added and mixed until evenly dispersed. The dye was then mixed in until evenly dispersed. Viscosity-680 cps.; 1.21 s.g.; pH 1.9.

Rhodopol 23 is xanthan gum and Veegum T is magnesium aluminum silicate. Both are available from R.T. Vanderbilt Co. Inc. Norwalk, Conn.

Surfonic N-95 is a surfactant (nonoxynol 10) and is available from Texaco Chemical Co.

Acid Foamer (tallow ethoxylated quaternary ammonium chloride) is available from Tomah Products, Inc., Exxon Chemical Co., Milton, Wisconsin.

Kaopolite 1168 is aluminum silicate and is available Kaopoite Inc., Combustion Engineering, Inc., Union, N.J.

Graphtol Green 5869-2 is a pigment available from Sandoz Colors & Chemicals.

Examples 18–20

As seen in the table below comparing the above prepared formulation (Example 18) with two different Lime-A-Way products purchased in two different cities namely Chicago, Ill. (Example 19) and Elizabeth, N.J. (Example 20), the product of Example 18 containing ferrous ion is significably superior to the commercially available formulations of Example 19 and 20, which do not contain ferrous ion, even though the formulation contains 21% phosphoric acid. The apparent reason that Example 18 is inferior to Example 12, to which it is similar, is the presence of the excipients.

| | Example | | |
|---|---|---|---|
| | 18 Formulation**** 918/103 | 19 Lime-A-Way purchased Chicago, Ill. July 2, 1986 | 20 Lime-A-Way purchased Elizabeth N.J. Sept. 20, 1985 |
| Oxalic Acid* | 2.0 | — | — |
| Sulfamic Acid | 7.0% | — | 7.0% |
| Hydroxyacetic Acid** | 28.6% | 3–10% | — |
| Ferrous Sulfate | 0.3 | — | — |
| Citric Acid | — | — | 16.0% |
| Phosphoric Acid | — | 21.5% | — |
| Excipients | (48.1) | (74.3–67.3) | (75%) |
| Surfactants | | 1.20 | 2.00 |
| Abrasives | | — | — |
| Dye | | 0.05 | 0.02 |
| Perfume | | 0.05 | 0.10 |

-continued

| | Example | | |
|---|---|---|---|
| | 18 | 19 | 20 |
| | Formulation**** 918/103 | Lime-A-Way purchased Chicago, Ill. July 2, 1986 | Lime-A-Way purchased Elizabeth N.J. Sept. 20, 1985 |
| Stain Removal % | 52 | 36 | 4 |

*Dihydrate
**70%
***Heptahydrate
****Contains the following excipents:
xanthan gum
nonoxynol 10 (surfactant)
tallow ethoxylated quaternary ammonium chloride (surfactant)
aluminum silicate - anhydrous (abrasives)
pigment The ferrous ion compounds tends to oxidize to the corresponding ferric ion compound. The shelf life can be extended by storing in a oxygen barrier type container. Alternatively, an oxidation inhibiting substance for the system can be added. Illustory oxidation inhibiting substances are erythoribic acid and ascorbic acid. Another alternative would be to increase the ferrous ion containing compound level so that a portion acts as a sacrifical agent leaving still a portion still unoxidized. Another alternative would be to manufacture, package and store under nitrogen or other inert gases. Obviously, if this is done an oxygen barrier type container, e.g. glass, would also be desirable. Other conventional means for slowing down the oxidation of oxidizable substances can be utilized to decrease the ferrous ion oxidation while in the container.

It will be understood that various changes, modifications and alterations may be made in the instant invention without departing from the spirit and scope thereof and as such the invention is not to be limited except by the appended claims.

We claim:

1. A non-phosphate cleaning composition having enhanced rust removal properties at ambient temperatures comprising oxalic acid with from 0.1% to 0.6% by weight based on the total composition of ferrous ion and less than 1% by weight based on the total composition of mineral acids.

2. The cleaning composition of claim 1, wherein the compound providing ferrous ion is an organic compound.

3. The cleaning composition of claim 1, wherein the compound providing ferrous ion is an inorganic compound.

4. The cleaning composition of claim 2, wherein the organic compound is selected from the group consisting of ferrous acetate, ferrous gluconate, ferrous methoxide and ferrous oxalate.

5. The cleaning composition of claim 3, wherein the inorganic compound is selected from the group consisting of ferrous chloride, ferrous fluoride, ferrous tetrafluoroborate, ferrous ammonium sulfate, ferrous perchlorate, and ferrous sulfate.

6. The cleaning composition of claim 5, wherein the inorganic compound is ferrous sulfate.

7. The cleaning composition of claim 1, which also contains hydroxyacetic acid.

8. A method of removing rust stains from a solid surface at ambient temperature, which comprises applying thereto an acidic substance comprising oxalic acid with from 0.01% to 0.6% by weight based on the total composition of ferrous ion and less than 1% by weight based on the total composition of mineral acids, and rinsing off said acidic substance.

* * * * *

UNITED STATES PATENT AND TRADEMARK OFFICE

CERTIFICATE OF CORRECTION

PATENT NO. : 4,828,743

DATED : May 9, 1989

INVENTOR(S) : Susan Rahfield, et al.

It is certified that error appears in the above-identified patent and that said Letters Patent is hereby corrected as shown below:

Column 8, line 6 (Claim 1) "0.1%" should read --0.01%--.

Signed and Sealed this

First Day of June, 1993

*Attest:*

*Attesting Officer*

Michael K. Kirk

MICHAEL K. KIRK

*Acting Commissioner of Patents and Trademarks*